US011988048B2

(12) United States Patent
Greci

(10) Patent No.: US 11,988,048 B2
(45) Date of Patent: May 21, 2024

(54) SELF-LOCKING COUPLER

(71) Applicant: Halliburton Energy Services, Inc., Houston, TX (US)

(72) Inventor: Stephen Michael Greci, Little Elm, TX (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 222 days.

(21) Appl. No.: 17/412,628

(22) Filed: Aug. 26, 2021

(65) Prior Publication Data

US 2021/0388680 A1 Dec. 16, 2021

Related U.S. Application Data

(63) Continuation of application No. 15/779,022, filed as application No. PCT/US2016/024542 on Mar. 28, 2016, now Pat. No. 11,131,152.

(51) Int. Cl.
*E21B 17/043* (2006.01)
*E21B 17/046* (2006.01)

(52) U.S. Cl.
CPC ..... *E21B 17/043* (2013.01); *E21B 17/046* (2013.01)

(58) Field of Classification Search
CPC .... E21B 17/043; E21B 17/046; F16L 15/001; F16L 15/002; F16L 15/08; F16L 19/005
See application file for complete search history.

(56) References Cited

U.S. PATENT DOCUMENTS

| | | | |
|---|---|---|---|
| 4,902,045 | A | 2/1990 | McGugan et al. |
| 6,902,006 | B2 | 6/2005 | Myerley et al. |
| 8,757,671 | B2 | 6/2014 | Pallini, Jr. et al. |
| 9,145,745 | B2 | 9/2015 | Pallini, Jr. et al. |
| 2007/0252387 | A1 | 11/2007 | Beard et al. |
| 2015/0060049 | A1 | 3/2015 | Saurer et al. |
| 2015/0101804 | A1 | 4/2015 | Vu |
| 2015/0323109 | A1 | 11/2015 | Snyder et al. |
| 2015/0330177 | A1 | 11/2015 | Williams et al. |
| 2015/0376993 | A1 | 12/2015 | Vass et al. |

FOREIGN PATENT DOCUMENTS

| | | | |
|---|---|---|---|
| EP | 0489527 | A1 | 6/1992 |
| WO | 2014077800 | A1 | 5/2014 |

OTHER PUBLICATIONS

International Search Report and Written Opinion dated Dec. 19, 2016; International PCT Application No. PCT/US2016/024542.

*Primary Examiner* — Matthew Troutman
*Assistant Examiner* — Fannie C Kee
(74) *Attorney, Agent, or Firm* — Barnes & Thornburg LLP

(57) ABSTRACT

The disclosed embodiments include a self-locking coupler, a method to couple adjacent tubing sections, and a self-locking coupling assembly. In one embodiment, the self-locking coupler includes a coupling shroud having an external interface proximate to a first end of the coupling shroud and a set of collet fingers that extends from the first end of the coupling shroud. The self-locking coupler also includes a locking sleeve having an internal interface that complements the external interface of the coupling shroud. The locking sleeve is movable from a first position on the external interface to a second position on the external interface. As the locking sleeve moves from the first position to the second position, the locking sleeve compresses the set of collet fingers into a cavity of a first seal ring coupled to a first tubing section to secure the coupling shroud to the first tubing section.

10 Claims, 7 Drawing Sheets

SELF-LOCKING COUPLER

CROSS-REFERENCE TO RELATED APPLICATIONS

This application is a continuation of U.S. patent application Ser. No. 15/779,022 filed on May 24, 2018, which is hereby incorporated by reference.

BACKGROUND

The present disclosure relates to oil and gas exploration and production, and more particularly to a self-locking coupler for joining together adjacent tubing sections in a tool string.

Wells are drilled at various depths to access and produce oil, gas, minerals, and other naturally-occurring deposits from subterranean geological formations. Wells are also drilled in a variety of environments, including in deep water where ocean floor conditions may be softer or more unconsolidated. In such wells, tool strings such as drill strings and completion strings may extend to a variety of depths and may follow relatively circuitous paths to reach a location of a geological formation that is rich in extractable hydrocarbons.

To deploy tools at different locations and depths in the wellbore, a tool string, which may include a running tool, may be used to deploy tools or other devices. To form the tool string, tubing sections may be coupled together by couplers or coupling assemblies. Couplers and coupling assemblies may be installed on the surface to fixedly engage adjacent sections of the tool string and to seal the boundaries of the adjacent sections to prevent leakage at the boundaries. Many types of couplers and coupling assemblies are installed manually by technicians or by machines using hand tools before the adjacent sections are deployed into the well. However, installation errors may cause hand tools to fall into the well. Retrieval of such tools is not only a difficult process, but also delays well operations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1A:
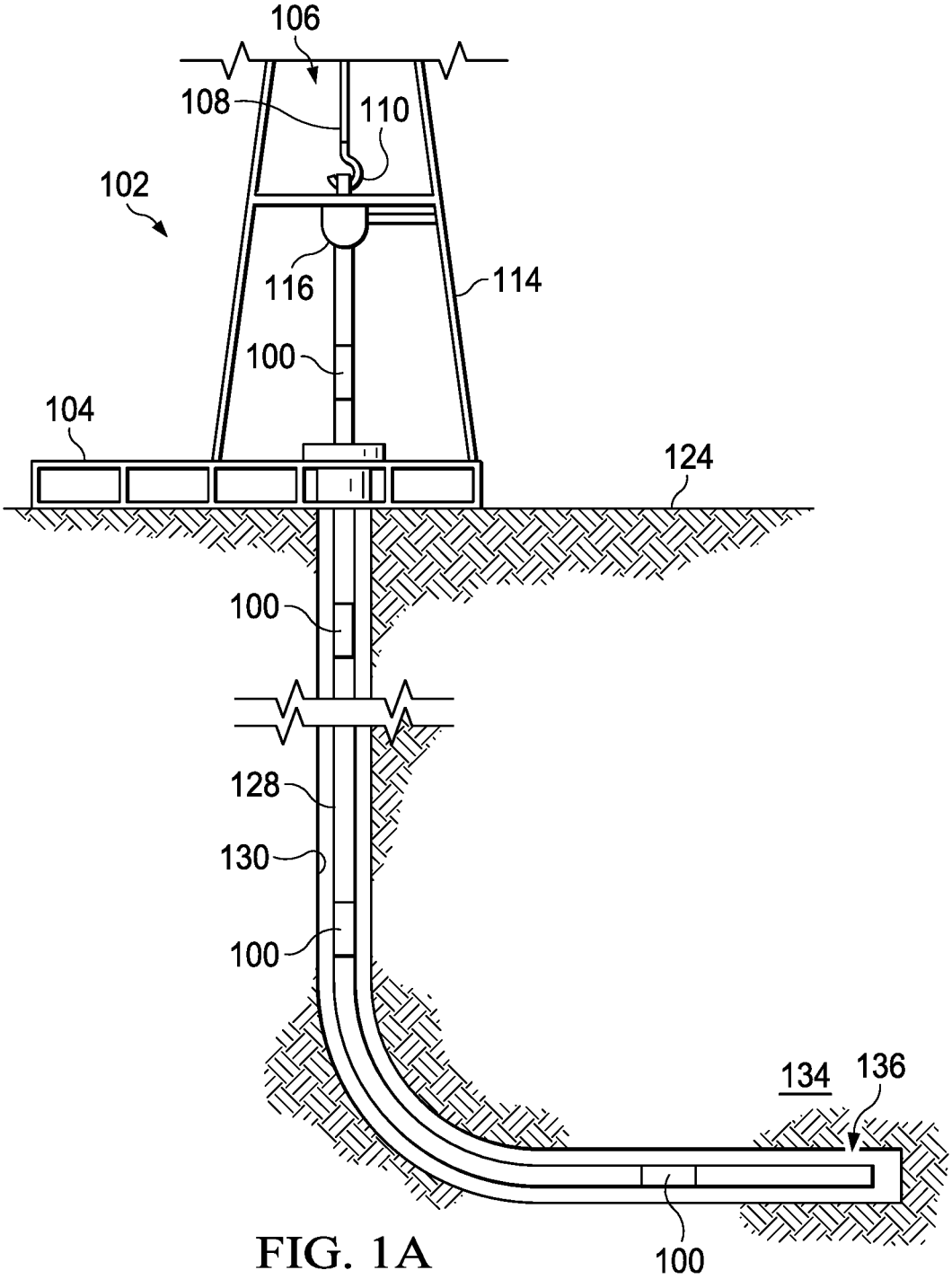
FIG. 1A illustrates a schematic view of an on-shore well in which a tool string is deployed.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

A self-locking coupler may be deployed to couple adjacent sections of a tool string to fixedly secure the adjacent sections and also to seal the boundaries of the adjacent sections. The self-locking coupler includes a coupling shroud having an internal interface that wraps around two adjacent tubing sections and an external interface proximate to a first end of the coupling shroud. The self-locking coupler also includes a set of collet fingers that extends from the first end of the coupling shroud. Each collet finger of the set of collet fingers includes a shoulder. In some embodiments, the shoulder has a high angle. In other embodiments, the shoulder has a back angle. The set of collet fingers is positioned around a first seal ring having an internal interface that is engaged to a first tubing section of the adjacent tubing sections and having an external interface that includes a cavity.

The self-locking coupler also includes a locking sleeve that is engaged to the external interface of the coupling shroud. The locking sleeve includes a shoulder and an internal interface that complements the external interface of the coupling shroud. Moreover, the locking sleeve is movable from a first position on the external interface of the coupling shroud to a second position on the external interface of the coupling shroud. In some embodiments, the internal interface of locking sleeve and the external interface of the coupling shroud are threaded interfaces. In one of such embodiments, the locking sleeve moves from the first position to the second position by rotating around the threaded external interface of the coupling shroud. As the locking sleeve rotates from the first positon to the second position, the locking sleeve compresses the set of collet fingers into the cavity of the first seal ring, thereby securing the coupling shroud to the first tubing section. The locking sleeve may be rotated from the first position to the second position by a technician or machine on the surface without using any small hand tools. Once the locking sleeve rotates to the second position, the shoulder of the collet fingers and the shoulder of the locking sleeve prevent the locking sleeve from rotating back to the first position.

Figure 1B:
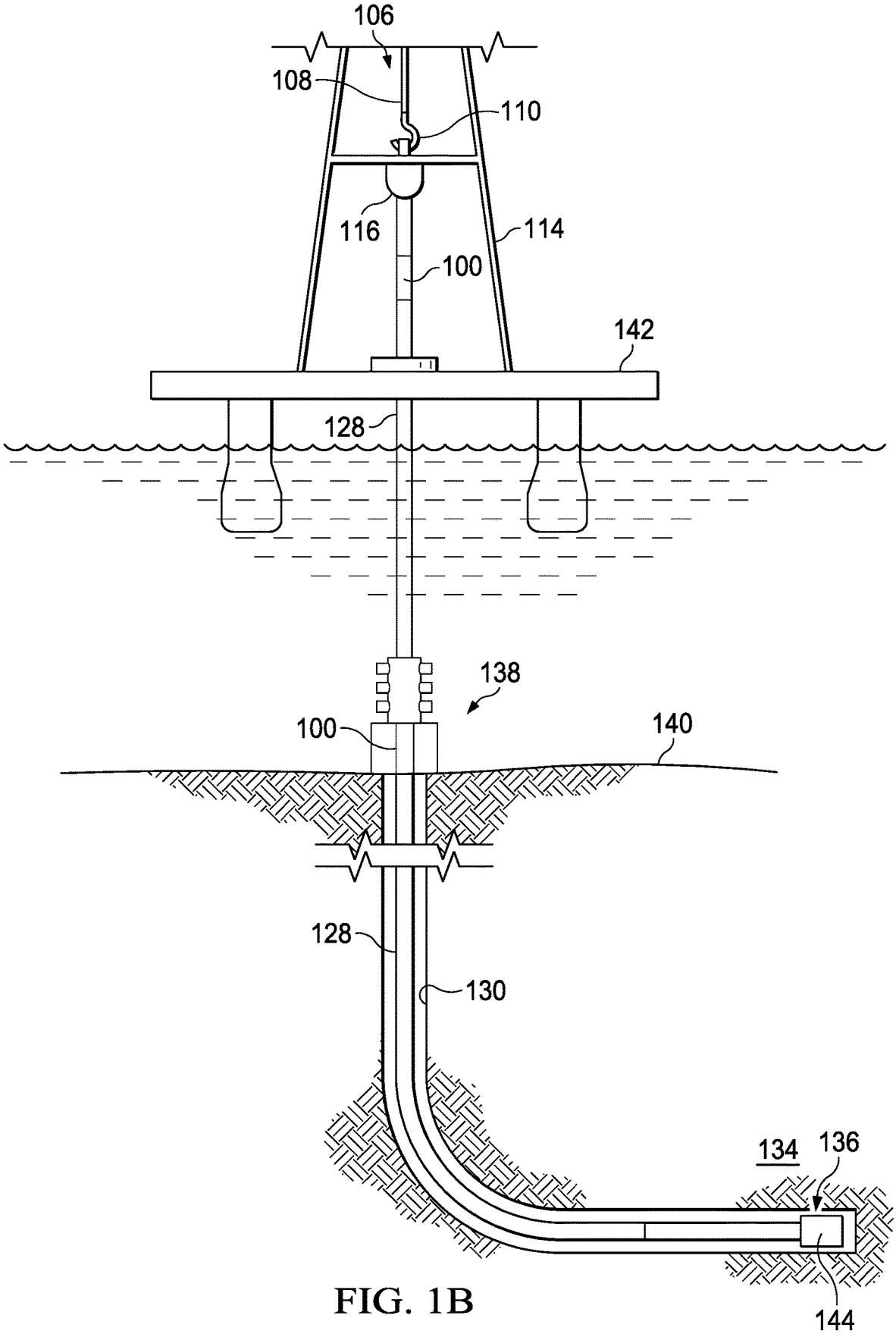
FIG. 1B illustrates a schematic view of an off-shore well in which a tool string is deployed.

Turning now to the figures, FIG. 1A illustrates a schematic view of a rig 104 in which a tool string 128 having multiple segments coupled by self-locking couplers 100. The rig 104 is positioned at a surface 124 of a well 102. The well 102 includes a wellbore 130 that extends from the surface 124 of the well 102 to a subterranean substrate or formation 134. Alternatively, FIG. 1B illustrates a schematic view of an off-shore platform 142 operating a tool string 128 that includes self-locking couplers 100. The self-locking couplers 100 in FIG. 1B may be deployed to couple sections of the tool string 128 in a sub-sea well 138 accessed by the offshore platform 142. As defined herein, the "offshore platform" 142 may be a floating platform, a platform anchored to a seabed 140 or a vessel.

FIGS. 1A and 1B each illustrate possible uses or deployments of the self-locking coupler 100, which in either instance may be used in the tool string 128 to deploy a tool 144 or other device downhole. In the embodiments illustrated in FIGS. 1A and 1B, the wellbore 130 has been formed by a drilling process in which dirt, rock and other subterranean material has been cut from the formation 134 by a drill bit operated via a drill string to create the wellbore 130. During or after the drilling process, a portion of the wellbore 130 may be cased with a casing (not illustrated in FIGS. 1A and 1B). In other embodiments, the wellbore may be maintained in an open-hole configuration without casing.

The tool string 128 may include sections of tubing, each of which are joined to adjacent tubing by threaded or other connection types, such as the self-locking coupler 100. The tool string 128 may refer to the collection of pipes, mandrels or tubes as a single component, or alternatively to the individual pipes, mandrels, or tubes that comprise the string. The term tool string is not meant to be limiting in nature and may include a running tool or any other type of tool string used to deploy the tool 144 or other downhole equipment in the wellbore 130. In some embodiments, the tool string 128 may include a passage disposed longitudinally in the tool string 128 that is capable of allowing fluid communication between the surface 124 of the well 102 and a downhole location 136.

The lowering of the tool string 128 may be accomplished by a lift assembly 106 associated with a derrick 114 positioned on or adjacent to the rig 104 or offshore platform 142. The lift assembly 106 may include a hook 110, a cable 108, a traveling block (not shown), and a hoist (not shown) that cooperatively work together to lift or lower a swivel 116 that is coupled an upper end of the tool string 128. The tool string 128 may be raised or lowered as needed to add additional sections of tubing to the tool string 128 to position the distal end of the tool string 128 at the downhole location 136 in the wellbore 130.

Figure 2A:
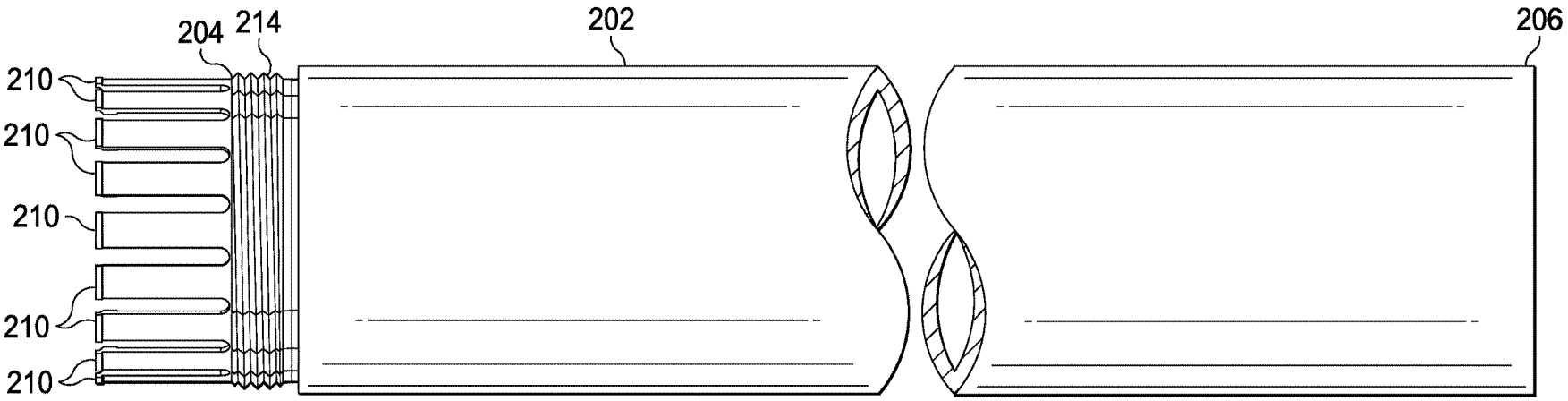
FIG. 2A illustrates a schematic, side view of a coupling shroud having a set of collet fingers extending from one end of the coupling shroud.
Figure 2B:
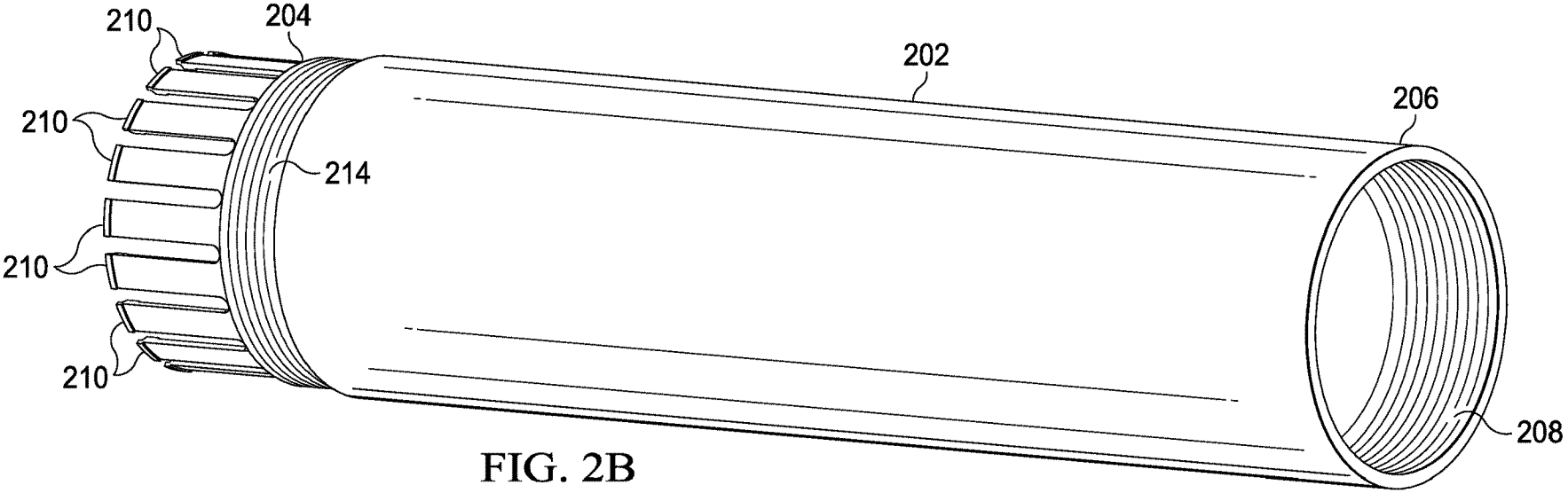
FIG. 2B illustrates a schematic, perspective view of the coupling shroud of FIG. 2A.

FIGS. 2A and 2B illustrate a side view and a perspective view of a coupling shroud 202 component of the self-locking coupler 100 of FIG. 1. The coupling shroud 202 includes an external interface 214 proximate to a first end 204 of the coupling shroud 202. In some embodiments, the external interface 214 is a threaded external interface. The coupling shroud 202 also includes collet fingers 210 attached to the first end 204 of the coupling shroud 202. The collet fingers 210 are compressible to fixedly secure the coupling shroud 202 to a tubing section (not shown) or to another joint engaged to the tubing section. In some embodiments, the coupling shroud also includes a locking sleeve (not shown) engaged to the coupling shroud 202 and having an internal interface that complements the external interface 214 of the coupling shroud 202. In one of such embodiments, the locking sleeve compresses the collet fingers 210 as the locking sleeve rotates from a first position on the external interface 214 of the coupling shroud 202 towards a second position on the external interface 214 of the coupling shroud 202.

The coupling shroud also includes an internal interface 208 that extends from the first end 204 to a second end 206 of the coupling shroud 202. The internal interface 208 wraps around adjacent first and second tubing sections (not shown) of the tubing string 128 or around joints engaged to the adjacent tubing sections. In some embodiments, the internal interface 208 includes a threaded interface proximate to the second end 206 that complements a threaded external interface of the second tubing section of the adjacent tubing sections. In such embodiments, the internal interface 208 is threaded onto the second tubing section. Additional descriptions and illustrations of the coupling shroud 202, the collet fingers 210, and the locking sleeve are provided in the paragraphs below and are illustrated in FIGS. 3A, 3B, 4A, 4B, and 5.

Figure 3A:
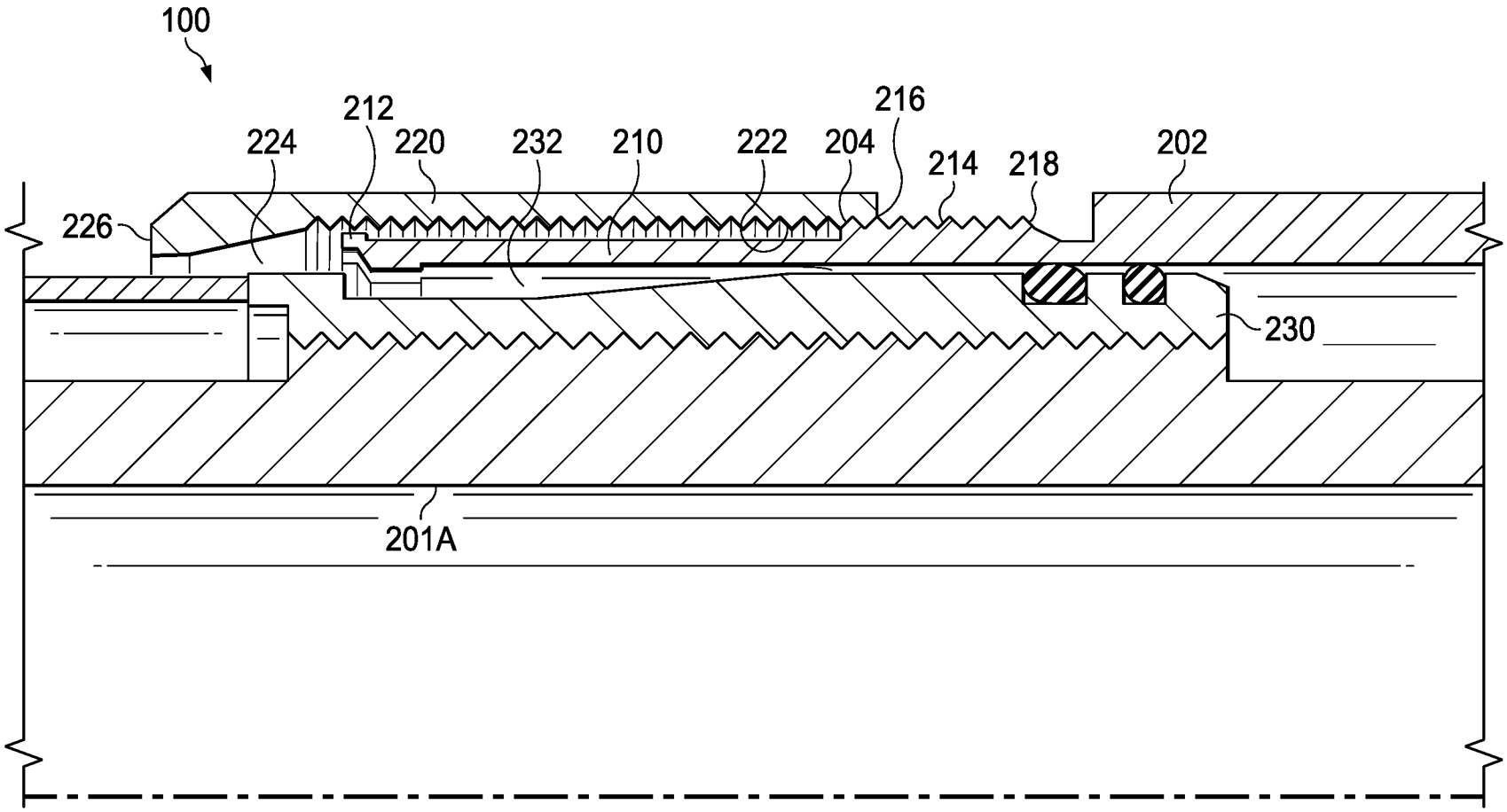
FIG. 3A illustrates a schematic, cross sectional view of a portion of a self-locking coupler in a disengaged position.
Figure 3B:
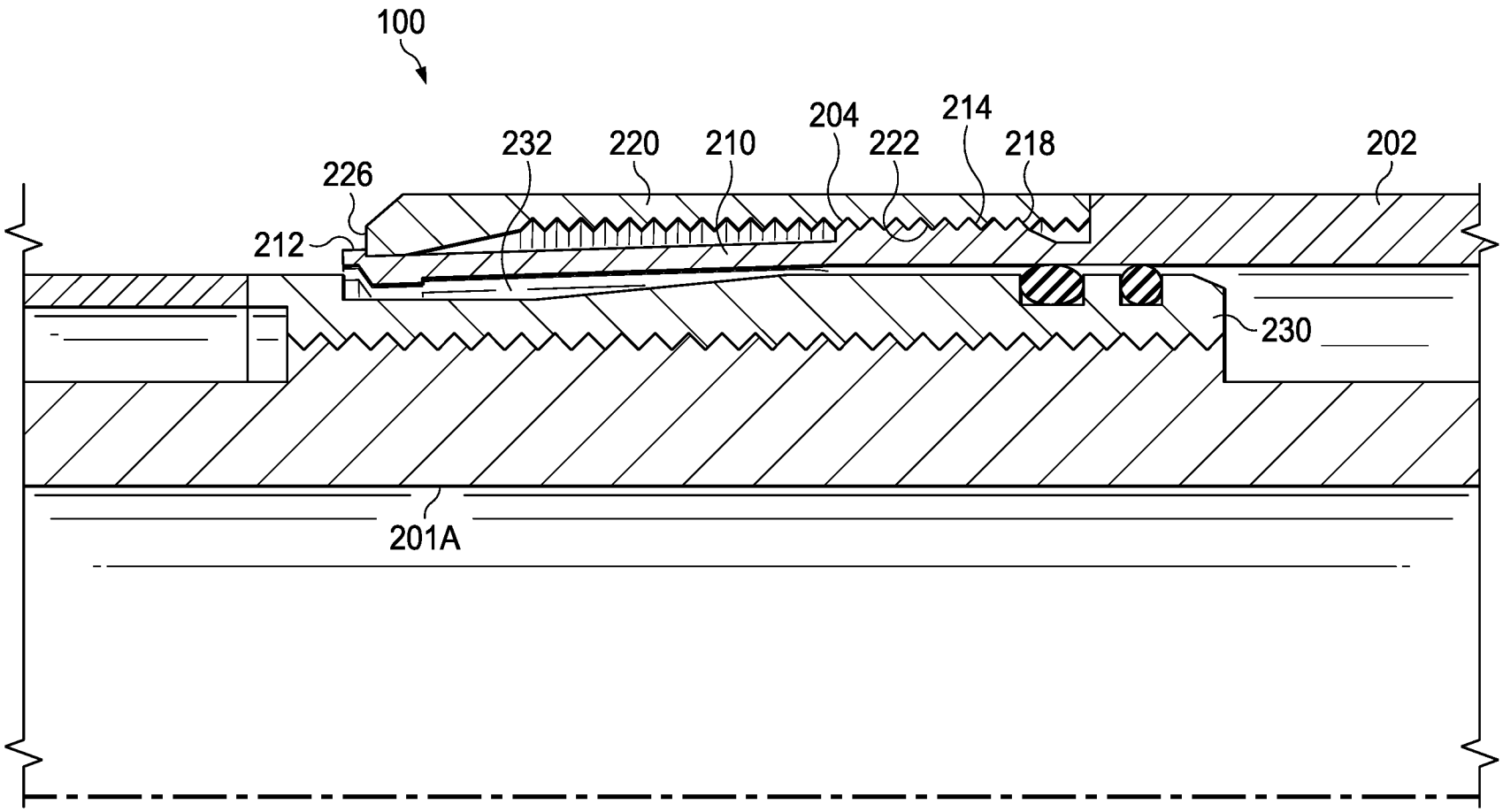
FIG. 3B illustrates a schematic, cross sectional view of a portion of the self-locking coupler of FIG. 3A in an engaged position.

FIGS. 3A and 3B illustrate schematic, cross sectional views of a section of the self-locking coupler 100 of FIG. 1 in a disengaged and an engaged position, respectively. In FIG. 3A, a seal ring 230 having a cavity 232 is coupled to a first tubing section 201A. A collet finger 210 having a shoulder 212 extends from a first end 204 of the coupling shroud 202. The collet finger 210 is positioned proximate to the cavity 232 of the seal ring 230.

A locking sleeve 220 is engaged to an external interface 214 of the coupling shroud 202 at a first position 216 on the external interface 214 of the coupling shroud 202.

The locking sleeve 220 includes a shoulder 226 and a recess 224 along an internal interface 222 of the locking sleeve 220. As illustrated in FIG. 3, the recess 224 encloses the shoulder 212 of the collet finger 210 while the self-locking coupler 100 is in a disengaged position. Further, the internal interface 222 complements the external interface 214 of the coupling shroud 202 to facilitate the locking sleeve 220 to move from the first position 216 on the external interface 214 to a second position 218 on the external interface 214.

In some embodiments, the internal interface 222 of the locking sleeve 220 and the external interface 214 of the coupling shroud 202 are both threaded interfaces. In such embodiments, the locking sleeve 220 is rotatable along the external threaded interface of the coupling shroud 202 to move from the first position 216 on the external interface 214 towards a second position 218 on the external interface 214. As the locking sleeve 220 moves from the first position 216 on the external interface 214 towards the second position 218 of the external interface 214, the shoulder 226 of the locking sleeve 220 engages the collet finger 210 to compress the collet finger 210 inward into the cavity 232 of the seal ring 230. When the locking sleeve 220 is approximately at the second position 218 on the external interface 214 of the coupling shroud 202, the shoulder 226 of the locking sleeve 220 moves past the shoulder 212 of the collet finger 210, thereby engaging the collet finger 210 to the seal ring 230.

In FIG. 3B, the locking sleeve 220 has moved to the second position 218 on the external interface 214 of the coupling shroud 202. At the engaged position illustrated in FIG. 3B, the shoulder 212 of the collet finger 210 forms a barrier that inhibits the locking sleeve 220 from moving from the second position 218 on the external interface 214 towards the first position 216 on the external interface 214. Additional discussions and illustrations of the shoulder 212 of the collet finger 210, the shoulder 226 of the locking sleeve 220 are provided in the paragraphs below and are illustrated in FIGS. 4A and 4B.

Although FIGS. 3A and 3B illustrate one collet finger 210, additional collet fingers 210 may extend from the first end 204 of the coupling shroud 202. In such embodiments, the locking sleeve 220 compresses each of the collet fingers 210 into the cavity 232 of the seal ring 230 as the locking sleeve 220 moves from the first position 216 on the external surface 214 of the collet finger 210 towards the second position 218 on the external surface 214 of the collet finger 210. Although FIGS. 3A and 3B illustrate a seal ring 230 engaged to the first tubing section 201A, other types of rings, joints, bolts having a shoulder and cavity for receiving the collet finger 210 may be engaged to the first tubing section.

Figure 4A:
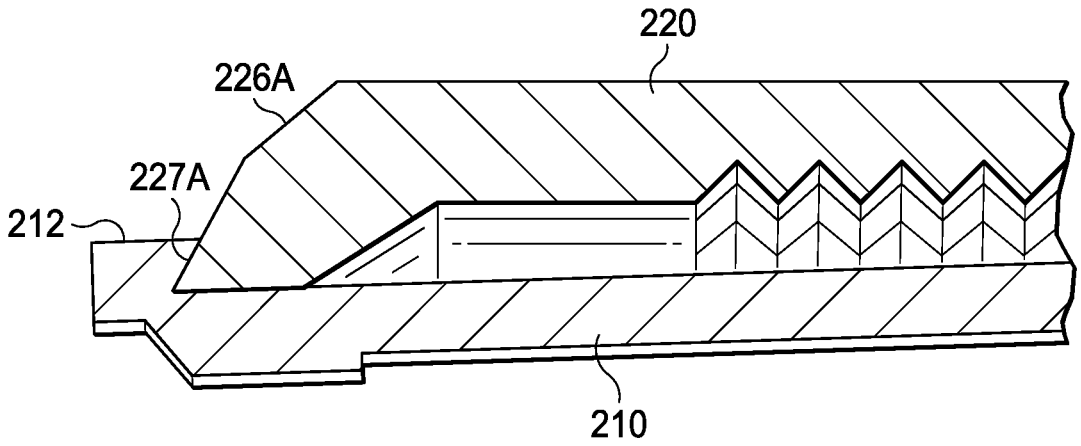
FIG. 4A illustrates a schematic, cross sectional view of a shoulder of a collet finger having a back angle to engage the locking sleeve.

FIG. 4A illustrates a schematic, cross sectional view of the shoulder 212 of the collet finger 210 having a back angle to engage the locking sleeve 220. FIG. 4B illustrates a schematic, cross sectional view of the shoulder 212 of the collet finger 210 having a high angle to engage the locking sleeve 220. In the embodiment illustrated in FIG. 4A, shoulder 226A of the locking sleeve 220 has an interface 227A that complements an interface of the shoulder 212 of the collet finger 210.

Figure 4B:
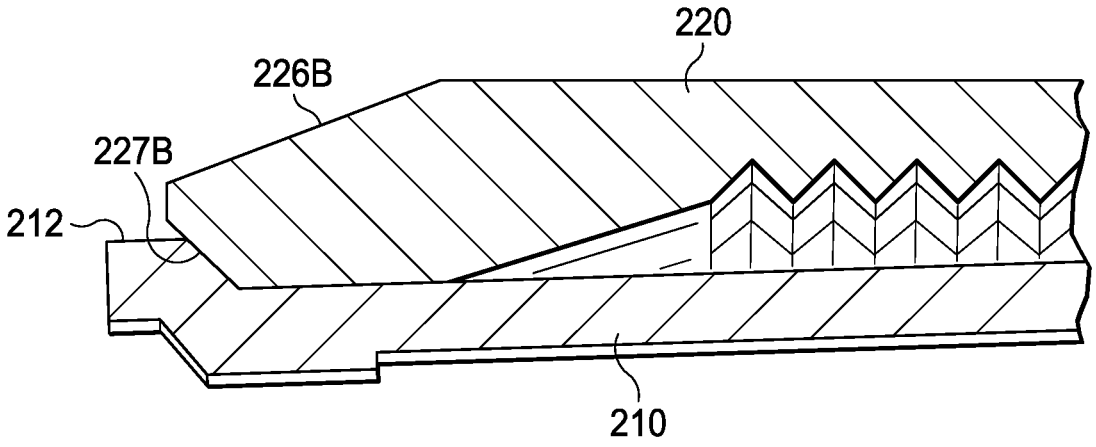
FIG. 4B illustrates a schematic, cross sectional view of a shoulder of the collet finger having a high angle to engage the locking sleeve.

Similarly, in the embodiment illustrated in FIG. 4B, shoulder 226B of the locking sleeve 220 has an interface 227B that complements an interface of the shoulder 212 of the collet finger 210. The complementary interfaces prevent the locking sleeve 220 from disengaging the collet finger 210 once the collet finger 210 is engaged to the seal ring 230. In some embodiments, the back angle of the shoulder 212 is between 5 degrees and 30 degrees. In some embodiments, the high angle of the shoulder 212 is between 5 degrees and 30 degrees. The degree of the back angle and high angle may vary based on a variety of considerations such as, but not limited to the materials used to form the shoulder 212, the expected force exerted onto the shoulder 212, the diameter of the tubing segment, and the dimensions of the shoulder 212.

Figure 5:
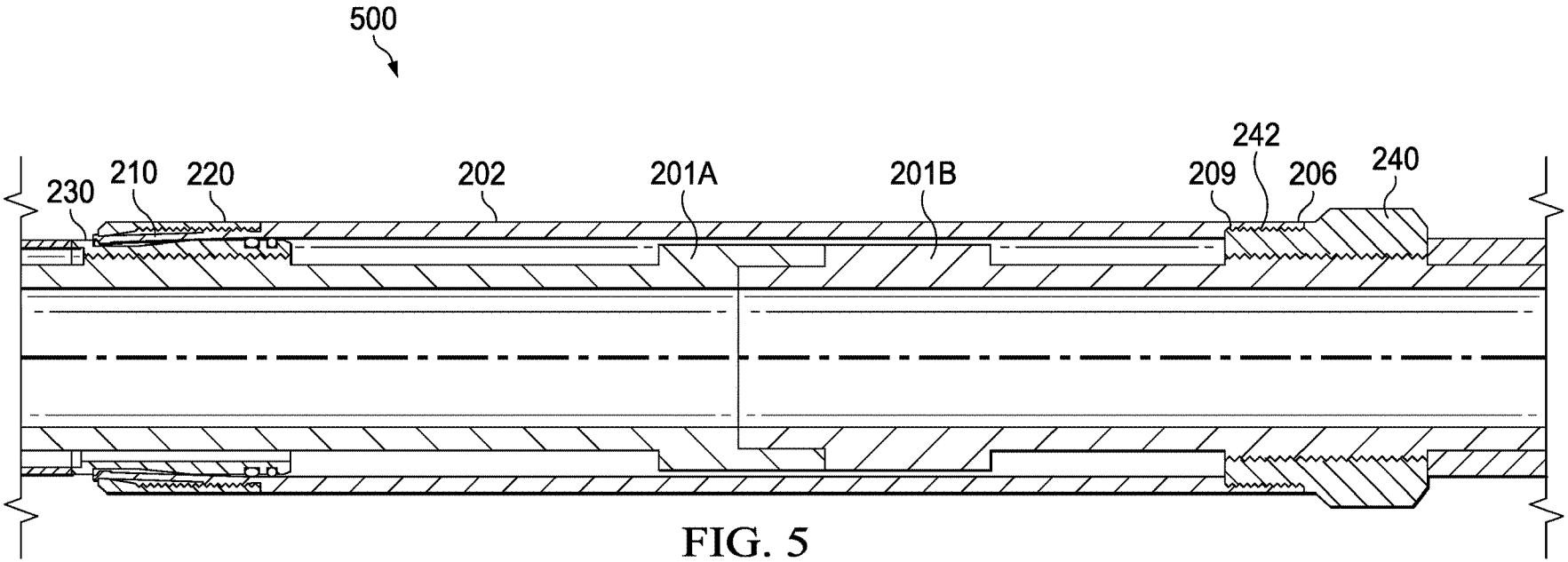
FIG. 5 illustrates a perspective, cross sectional view of a self-locking coupling assembly that is coupled to adjacent tubing sections.

FIG. 5 illustrates a perspective, cross sectional view of a self-locking coupling assembly 500 that is coupled to two adjacent tubing sections. In the embodiment of FIG. 5, the self-locking coupling assembly 500 includes a first seal ring 230 having a cavity 232, a second seal ring 240 having a threaded interface, and the self-locking coupler 100. To deploy the self-locking coupling assembly 500, the first seal ring 230 and the second seal ring 240 are engaged to a first tubing section 201A and a second tubing section 201B, respectively. In some embodiments, the first seal ring 230 and the second seal ring 240 have threaded internal interfaces and are threaded onto the first and second tubing sections 201A and 201B, respectively.

In the embodiment illustrated in FIG. 5, the coupling shroud 202 has an internal threaded interface 209 proximate to the second end 206 that complements an external threaded interface 242 of the second seal ring 240. In such embodiment, the coupling shroud 202 is threaded onto the second seal ring 240 to engage the self-locking coupler 100 to the second tubing section 201B. The coupling shroud 202 has a length that is approximately the distance from the first seal ring 230 to the second seal ring 240 such that once the coupling shroud 202 is threaded onto the second seal ring 240, the collet fingers 210 extend over the cavity 232 of the first seal ring 230. The locking sleeve 220 is then moved from the first position 216 on the external interface 214 of the coupling shroud 202 to the second position 218 on the external interface 214 of the coupling shroud 202.

In some embodiments, the external interface 214 of the coupling shroud 202 and the internal interface 222 of the locking sleeve are threaded interfaces. In such embodiments, the locking sleeve 220 rotates about the external interface 214 of the coupling shroud 202 from the first position 216 on the external interface 214 towards the second position 218 on the external interface 214. As the locking sleeve 220 rotates towards the second position 218 on the external interface 214, the locking sleeve 220 compresses the collet fingers 210 into the cavity 232 of the first seal ring 230. Once the locking sleeve 220 is approximately at the second position 218 on the external interface 214, the self-locking coupling assembly 500 is engaged to the first tubing section 201A. More particularly, the shoulder 226 of the locking sleeve 220 is engaged to the shoulder 212 of the collet fingers 210, thereby preventing the locking sleeve 220 from rotating towards the first position 216.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a self-locking coupler, including a coupling shroud having an external interface proximate to a first end of the coupling shroud and a set of collet fingers extending from the first end of the coupling shroud; and a locking sleeve having an internal interface that complements the external interface of the coupling shroud, wherein the locking sleeve is moveable from a first position on the external interface of the coupling shroud to a second position on the external interface of the coupling shroud, and wherein the locking sleeve compresses the set of collet fingers into a cavity of a first seal ring coupled to a first tubing section to secure the coupling shroud to the first tubing section as the locking sleeve moves from the first position to the second position.

Clause 2, the self-locking coupler of clause 1, wherein the external interface of the coupling shroud and the internal interface of the locking sleeve comprise a threaded external interface and a threaded internal interface, respectively, and wherein the locking sleeve compresses the set of collet fingers into the cavity of the first seal ring as locking sleeve rotates about the threaded external interface from the first position to the second position.

Clause 3, the self-locking coupler of clause 1 or 2, wherein each collet finger of the set of collet fingers comprises a shoulder, and wherein once the locking sleeve is at the second position, the shoulder inhibits the locking sleeve from rotating from the second position towards the first position.

Clause 4, the self-locking coupler of any combination of clauses 1-3, wherein the shoulder has a back angle within a range of approximately 5 to 30 degrees.

Clause 5, the self-locking coupler of any combination of clauses 1-4, wherein the shoulder has a back angle of approximately 15 degrees.

Clause 6, the self-locking coupler of any combination of clauses 1-3, wherein the shoulder has a high angle within a range of approximately 5 to 30 degrees.

Clause 7, the self-locking coupler of any combination of clauses 1-3 and 6, wherein the shoulder has a high angle of approximately 15 degrees.

Clause 8, the self-locking coupler of any combination of clauses 1-7, wherein the coupling shroud comprises an internal interface proximate to a second end of the coupling shroud is coupled to a second seal ring having an internal interface coupled to an external interface of a second tubing section and having an external interface coupled to a second end of the coupling shroud.

Clause 9, a method to couple adjacent tubing sections, the method including engaging a seal ring to a first tubing section, the seal ring having a cavity along an external surface of the seal ring; engaging a coupling shroud to a second tubing section, the coupling shroud having an external interface proximate to a first end of the coupling shroud and a set of collet fingers extending from the first end of the coupling shroud; and rotating a locking sleeve having an internal interface that compliments the external interface of the coupling shroud from a first position on the external interface of the coupling shroud to a second position on the external interface of the coupling shroud to compress the set of collet fingers into the cavity of the seal ring.

Clause 10, the method of clause 9, wherein the coupling shroud comprises a threaded internal interface proximate to a second end of the coupling shroud, and wherein the threaded internal interface is engaged to a threaded external interface of a second seal ring having an internal interface coupled to an external interface of a second tubing section.

Clause 11, the method of clause 10 or 11, wherein each collet finger of the set of collet fingers comprises a shoulder, wherein rotating the locking sleeve comprises rotating the locking sleeve along a first direction from the first position to the second position, and wherein once the locking sleeve at approximately the second position, the shoulder inhibits the locking sleeve from rotating from the second position towards the first position.

Clause 12, the method of any combination of clauses 9-11, further comprising threading a second seal ring onto the second tubing section, wherein the coupling shroud comprises a threaded internal interface proximate to a second end of the coupling shroud, and wherein engaging the coupling shroud to the second tubing section comprises threading the threaded internal interface of the coupling shroud onto a threaded external interface of the second seal ring.

Clause 13, a self-locking coupling assembly, including a first seal ring engaged to a first tubing section, the first seal ring having an external interface and a cavity along the external interface; a second seal ring engaged to a second tubing section, the second tubing section being adjacent to the first tubing section; a coupling shroud having an external interface proximate to a first end of a coupling shroud and a set of collet fingers extending from the first end of the coupling shroud; and a locking sleeve having an internal interface that complements an external interface of the coupling shroud, the locking sleeve being rotatable from a first position on the external interface of the coupling shroud to a second position on the external interface of the coupling shroud, wherein the set of collet fingers engages the first tubing section as the locking sleeve moves from the first position to the second position.

Clause 14, the self-locking coupling assembly of clause 13, wherein the external interface of the coupling shroud and the internal interface of the locking sleeve comprise a threaded external interface and a threaded internal interface, respectively, and wherein the locking sleeve compresses the set of collet fingers into the cavity of the first seal ring as locking sleeve rotates about the threaded external interface from the first position to the second position.

Clause 15, the self-locking coupling assembly of clause 13 or 14, wherein each collet finger of the set of collet fingers comprises a shoulder, and wherein once the locking sleeve rotates to the second position, the shoulder inhibits the locking sleeve from rotating towards the first position.

Clause 16, the self-locking coupling assembly of any combination of clauses 13-15, wherein the shoulder has a back angle within a range of approximately 5 to 30 degrees.

Clause 17, the self-locking coupling assembly of any combination of clauses 13-16, wherein the shoulder has a back angle of approximately 15 degrees.

Clause 18, the self-locking coupling assembly of any combination of clauses 13-15, wherein the shoulder has a high angle within a range of approximately 5 to 30 degrees.

Clause 19, the self-locking coupling assembly of any combination of clauses 13-15 and 18, wherein the shoulder has a high angle of approximately 15 degrees.

Clause 20, the self-locking coupling assembly of any combination of clauses 13-19, wherein the coupling shroud comprises a threaded internal interface proximate to a second end of the coupling shroud, and wherein the threaded internal interface of the coupling shroud is engaged to a threaded external interface of the second seal ring.

Unless otherwise specified, any use of any form of the terms "connect," "engage," "couple," "attach," or any other term describing an interaction between elements in the foregoing disclosure is not meant to limit the interaction to direct interaction between the elements and may also include indirect interaction between the elements described. As used herein, the singular forms "a", "an" and "the" are intended to include the plural forms as well, unless the context clearly indicates otherwise. Unless otherwise indicated, as used throughout this document, "or" does not require mutual exclusivity.

It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof.

I claim:

1. A method to engage adjacent tubing sections, the method comprising:

engaging a seal ring to a first tubing section, the seal ring having a cavity along an external surface of the seal ring;

engaging a coupling shroud to a second tubing section, the coupling shroud having an external interface proximate to a first end of the coupling shroud and a set of collet fingers extending from the first end of the coupling shroud; and attaching a second seal ring onto the second tubing section wherein the coupling shroud comprises a threaded internal interface proximate to a second end of the coupling shroud, and wherein engaging the coupling shroud to the second tubing section comprises threading the threaded internal interface of the coupling shroud onto a threaded external interface of the second seal ring.

2. The method of claim 1, further comprising rotating a locking sleeve having an internal interface that compliments the external interface of the coupling shroud from a first position on the external interface of the coupling shroud to a second position on the external interface of the coupling shroud to compress the set of collet fingers into the cavity of the seal ring.

3. The method of claim 2, wherein the external interface of the coupling shroud is a threaded external interface, wherein the internal interface of the locking sleeve is the threaded internal interface that compliments the threaded external interface of the coupling shroud, and wherein rotating the locking sleeve comprises rotating the locking sleeve from the first position on the threaded external interface of the coupling shroud to the second position on the threaded external interface of the coupling shroud.

4. The method of claim 3, wherein each collet finger of the set of collet fingers comprises a shoulder, wherein rotating the locking sleeve comprises rotating the locking sleeve along a first direction from the first position to the second position, and wherein once the locking sleeve is in the second position, the shoulder inhibits the locking sleeve from rotating from the second position towards the first position.

5. The method of claim 4, wherein the shoulder has back angle within a range of 0 to 5 degrees.

6. The method of claim 4, wherein the shoulder has a back angle of approximately 15 degrees.

7. The method of claim 4, wherein the shoulder has a high angle within a range of approximately 5 to 45 degrees.

8. The method of claim 7, wherein the shoulder has a high angle within a range of approximately 5 to 30 degrees.

9. The method of claim 8, wherein the shoulder has a high angle of approximately 15 degrees.

10. The method of claim 1, wherein the seal ring has a threaded internal surface, wherein the first tubing section has a threaded external surface that compliments the threaded internal surface of the seal ring, and wherein engaging the seal ring to the first tubing section comprises rotating the seal ring from a first position to a second position on the threaded external surface of the first tubing section.

* * * * *